US011276538B2

(12) United States Patent
Minowa et al.

(10) Patent No.: US 11,276,538 B2
(45) Date of Patent: Mar. 15, 2022

(54) CONNECTION UNIT

(71) Applicant: Omron Corporation, Kyoto (JP)

(72) Inventors: Ryota Minowa, Yamaga (JP); Shingo Mori, Yamaga (JP)

(73) Assignee: Omron Corporation, Kyoto (JP)

( * ) Notice: Subject to any disclaimer, the term of this patent is extended or adjusted under 35 U.S.C. 154(b) by 177 days.

(21) Appl. No.: 16/640,889

(22) PCT Filed: Jul. 2, 2018

(86) PCT No.: PCT/JP2018/025094
§ 371 (c)(1),
(2) Date: Feb. 21, 2020

(87) PCT Pub. No.: WO2019/064778
PCT Pub. Date: Apr. 4, 2019

(65) Prior Publication Data

US 2020/0357591 A1 Nov. 12, 2020

(30) Foreign Application Priority Data

Sep. 27, 2017 (JP) ..... JP2017-186929

(51) Int. Cl.
*H01H 1/00* (2006.01)
*H01H 50/14* (2006.01)
*H01H 50/04* (2006.01)

(52) U.S. Cl.
CPC ..... *H01H 50/14* (2013.01); *H01H 50/04* (2013.01)

(58) Field of Classification Search
CPC ..... H01H 50/14; H01H 50/04; H01H 50/54; H01H 1/54; H01H 50/56; H01H 50/60; H01H 50/546; H01H 50/01
(Continued)

(56) References Cited

U.S. PATENT DOCUMENTS 6,700,466 B1 * 3/2004 Yamamoto ..... H01H 9/443 335/132
9,281,148 B2 * 3/2016 Enomoto ..... H01H 50/18
(Continued)

FOREIGN PATENT DOCUMENTS

CN 102891040 A 1/2013
CN 103843099 A 6/2014
(Continued)

OTHER PUBLICATIONS

Office Action in counterpart Chinese Patent Application No. 201880055151.3 dated Jul. 13, 2021 (9 pages).
(Continued)

*Primary Examiner* — Shawki S Ismail
*Assistant Examiner* — Lisa N Homza
(74) *Attorney, Agent, or Firm* — Osha Bergman Watanabe & Burton LLP

(57) ABSTRACT

A connection unit includes: an electromagnetic relay having a housing, a first fixed contact side terminal, a second fixed contact side terminal, and a movable touch piece; a first bus bar extending on an outside of the housing along a bus bar installation surface in an arrangement direction, and whose one end in the arrangement direction is connected to the first fixed contact side terminal; a second bus bar connected to the second fixed contact side terminal on the outside of the housing; and a bus bar position restrictor arranged on the bus bar installation surface with a gap in the arrangement direction from a connection point, and configured to restrict a position of the first bus bar in a contact/separation direction and in a direction away from the bus bar installation surface.

16 Claims, 7 Drawing Sheets

(58) Field of Classification Search
USPC ..... 335/196
See application file for complete search history.

(56) References Cited

U.S. PATENT DOCUMENTS

| | | | | |
|---|---|---|---|---|
| 9,564,279 | B2 * | 2/2017 | Naka | H01H 50/36 |
| 2013/0021121 | A1 | 1/2013 | Uchida | |
| 2013/0057369 | A1 * | 3/2013 | Yano | H01H 50/54 335/156 |
| 2013/0307649 | A1 | 11/2013 | Morimura | |
| 2013/0335175 | A1 * | 12/2013 | Tachikawa | H01H 3/222 335/147 |
| 2014/0015627 | A1 | 1/2014 | Uchida | |
| 2014/0062627 | A1 | 3/2014 | Naka et al. | |
| 2015/0002250 | A1 | 1/2015 | Kashimura et al. | |
| 2016/0133410 | A1 * | 5/2016 | Bock | H01H 47/325 361/160 |
| 2016/0254113 | A1 * | 9/2016 | Nishimura | H01H 50/02 335/202 |
| 2018/0096810 | A1 | 4/2018 | Murakoshi et al. | |
| 2019/0013171 | A1 * | 1/2019 | Minowa | H01H 50/546 |
| 2019/0131094 | A1 * | 5/2019 | Minowa | H01H 50/14 |
| 2019/0131095 | A1 * | 5/2019 | Minowa | H01H 50/443 |
| 2019/0148095 | A1 | 5/2019 | Minowa et al. | |
| 2019/0304724 | A1 * | 10/2019 | Minowa | H01H 1/62 |
| 2019/0304725 | A1 | 10/2019 | Minowa et al. | |
| 2019/0304729 | A1 * | 10/2019 | Minowa | H01H 50/58 |
| 2019/0311871 | A1 * | 10/2019 | Minowa | H01H 50/546 |
| 2020/0168408 | A1 * | 5/2020 | Mori | H01H 50/60 |
| 2021/0082648 | A1 * | 3/2021 | Harimochi | H01H 50/047 |
| 2021/0082651 | A1 * | 3/2021 | Kawaguchi | H01H 50/14 |
| 2021/0272763 | A1 * | 9/2021 | Mori | H01H 50/546 |
| 2021/0296070 | A1 * | 9/2021 | Kawaguchi | H01H 50/14 |

FOREIGN PATENT DOCUMENTS

| | | | |
|---|---|---|---|
| CN | 110323101 | A | 10/2019 |
| JP | 201341815 | A | 2/2013 |
| JP | 5778989 | B2 | 9/2015 |
| JP | 2018116766 | A | 7/2018 |
| KR | 10-2018-0037902 | A | 4/2018 |
| WO | 2013051264 | A1 | 4/2013 |
| WO | 2017183305 | A1 | 10/2017 |

OTHER PUBLICATIONS

International Search Report issued in International Application No. PCT/JP2018/025094, dated Sep. 25, 2018 (2 pages).

Written Opinion issued in International Application No. PCT/JP2018/025094; dated Sep. 25, 2018 (8 pages).

* cited by examiner

CONNECTION UNIT

TECHNICAL FIELD

The present disclosure relates to a connection unit including an electromagnetic relay and a bus bar connected to the electromagnetic relay.

BACKGROUND ART

Patent Document 1 discloses a contact device including a pair of fixed contactors arranged electrically independently of each other, and a rectangular plate-shaped movable contactor arranged so as to be in contact with and separate from the pair of fixed contactors. In this contact device, each of the pair of fixed contactors includes a support conductor portion fixed to a top plate of a storage case, and a C-shaped or inverted C-shaped contact conductor portion connected to an inner-side end of the storage case of the support conductor portion. Each contact conductor portion is constituted of an upper plate connected to the support conductor portion, a lower plate arranged to face the upper plate, and an intermediate plate connecting the upper plate and the lower plate, and a contact portion is provided on a surface of the lower plate facing the upper plate. Moreover, in the movable contactor, both end portions in a longitudinal direction are arranged between the upper plate and the lower plate of each contact conductor portion, and face each contact portion.

PRIOR ART DOCUMENT

Patent Document

Patent Document 1: Japanese Patent No. 5778989

SUMMARY OF THE INVENTION

Problems to be Solved by the Invention

As a method of improving contact reliability of the contact device, for example, there is considered a method of connecting a bus bar extending in the longitudinal direction of the movable contactor on the outside on a top surface of the storage case to any one of the pair of fixed contactors. In this method, because current flowing through the movable contactor and current flowing through the bus bar are in opposite directions, the movable contactor is pressed toward each contact portion by electromagnetic repulsive force generated due to the current flowing through the movable contactor and the bus bar, and accordingly, contact pressure between the movable contactor and each contact portion can be increased. As a result, the contact reliability of the contact device can be enhanced.

However, in the above-described method, the bus bar itself receives the electromagnetic repulsive force in a direction away from the top plate of the storage case, causing the bus bar to be deformed in the direction away from the top surface of the storage case. For this reason, the electromagnetic repulsive force generated due to the current flowing through the movable contactor and the bus bar is reduced, and the contact pressure between the movable contactor and each contact portion cannot be sufficiently increased, and as a result, the contact reliability of the contact device may not be sufficiently increased.

An object of the present disclosure is to provide a connection unit that can improve contact reliability.

Means for Solving the Problem

An example connection unit of the present disclosure is a connection unit including an electromagnetic relay including:

a housing having a compartment in an inside of the housing;

a first fixed contact side terminal fixed to the housing, and having a first fixed contact portion extending from an outside of the housing to the compartment and arranged in the compartment;

a second fixed contact side terminal fixed to the housing electrically independently of the first fixed contact side terminal, and having a second fixed contact portion extending from the outside of the housing to the compartment and arranged in the compartment; and a movable touch piece having a plate shape and arranged in the compartment, having a first movable contact portion arranged to face the first fixed contact portion and a second movable contact portion arranged to face the second fixed contact portion, and in which each of the first movable contact portion and the second movable contact portion is movable in a contact/separation direction in contact with or separated from the first fixed contact portion and the second fixed contact portion, respectively, the housing having a bus bar installation surface provided on an outer periphery of the housing and on a side of a second plate surface of the movable touch piece, the second plate surface being opposite in the contact/separation direction to a first plate surface on which the first movable contact portion and the second movable contact portion of the movable touch piece are provided, the first fixed contact side terminal having an end on an outer side of the housing, the end being positioned on a side of the bus bar installation surface in the contact/separation direction and on a one end side in an arrangement direction connecting the first movable contact portion and the second movable contact portion, the connection unit further including:

a first bus bar extending on the outside of the housing in the arrangement direction along the bus bar installation surface, overlapping with the movable touch piece in at least a portion of the first bus bar viewed from the contact/separation direction, and also connected to the first fixed contact side terminal at a one end in the arrangement direction, at a connection point on the one end side of the bus bar installation surface in the arrangement direction;

a second bus bar connected to the second fixed contact side terminal on the outside of the housing electrically independently of the first bus bar; and a bus bar position restrictor arranged on the bus bar installation surface with a gap in the arrangement direction from the connection point, and configured to restrict a position of the first bus bar in the contact/separation direction and in a direction away from the bus bar installation surface.

Effect of the Invention

According to the connection unit, on the bus bar installation surface, the bus bar position restrictor is provided with the gap in the arrangement direction from the connection point at which the first bus bar is connected at the one end thereof in the arrangement direction to the first fixed contact side terminal, and the bus bar position restrictor is configured to restrict the position of the first bus bar in the contact/separation direction and in the direction away from the bus bar installation surface. This bus bar position restrictor can maintain a state in which the first bus bar extends in the arrangement direction along the bus bar installation surface. Accordingly, the bus bar position restrictor can suppress the first bus bar from deforming in the contact/separation direction and in the direction away from the bus bar installation surface due to the electromagnetic repulsive force generated during energization between the movable touch piece and the first bus bar. As a result, it is possible to reduce the electromagnetic repulsive force generated between the movable touch piece and the first bus bar due to the deformation of the first bus bar, and to improve the contact reliability of the connection unit.

MODE FOR CARRYING OUT THE INVENTION

Hereinafter, an example of the present disclosure is described with reference to the accompanying drawings. In the following explanation, terms indicating specific directions or positions (for example, terms including "up", "down", "right", and "left") are used as necessary. However, the use of these terms is only for facilitating the understanding of the present disclosure with reference to the drawings, and the technical scope of the present disclosure is not limited by the meaning of these terms. Further, the following description is merely illustrative in nature and is not intended to limit the present disclosure, the application thereof, or the use thereof. Furthermore, the drawings are schematic, and the ratios of dimensions and the like do not necessarily match the actual dimensions.

Figure 1:
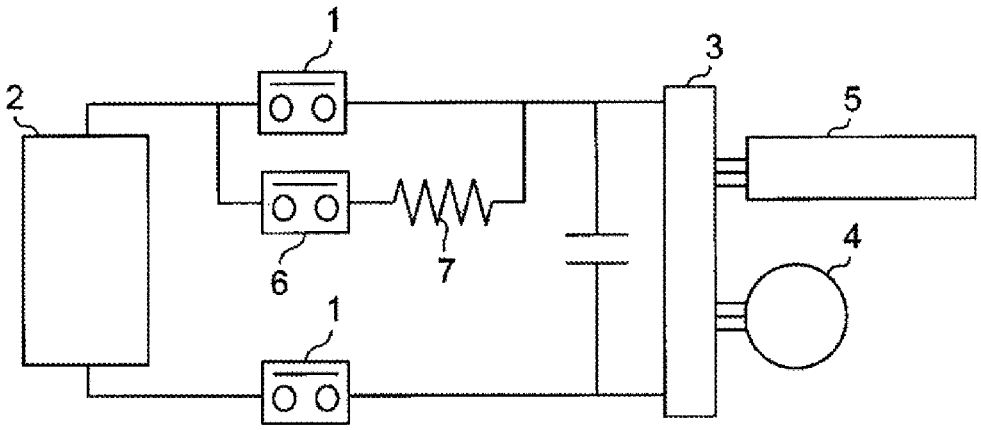
FIG. 1 is a circuit diagram showing an application example of a connection unit of an example of the present disclosure.

FIG. 1 shows an example of a scene to which the present disclosure is applied. The connection unit 1 of an example of the present disclosure is connected between, for example, a battery 2 and an inverter 3 of an electric vehicle, and is configured to open and close a power supply current path connected from the battery 2 to a motor 4 via the inverter 3, and also to open and close a charging current path connected to the battery 2 from a generator 5 via the inverter 3. A relay 6 and a resistor 7, both of which are used for precharge, are connected between the battery 2 and the inverter 3 in parallel with the connection unit 1.

First Embodiment

Next, a configuration of the connection unit 1 according to a first embodiment of the present disclosure is described.

Figure 2:
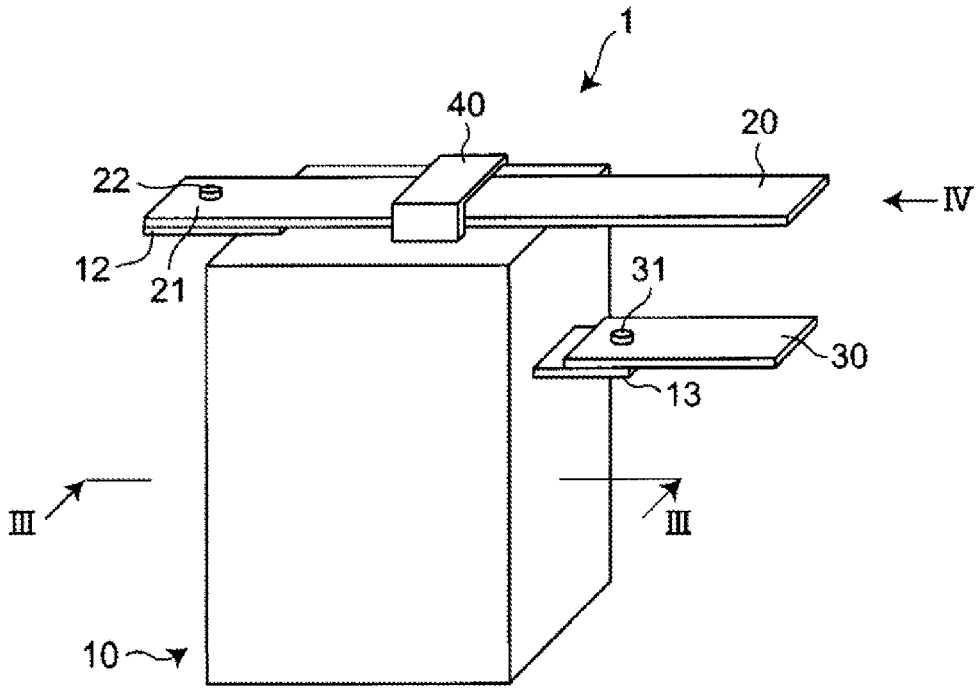
FIG. 2 is a perspective view of a connection unit according to a first embodiment of the present disclosure.

As shown in FIG. 2, the connection unit 1 of the first embodiment includes an electromagnetic relay 10, a first bus bar 20 and a second bus bar 30, both of which are connected to the electromagnetic relay 10, and a bus bar position restrictor 40 configured to restrict a position of the first bus bar 20 with respect to a housing 11.

Figure 3:
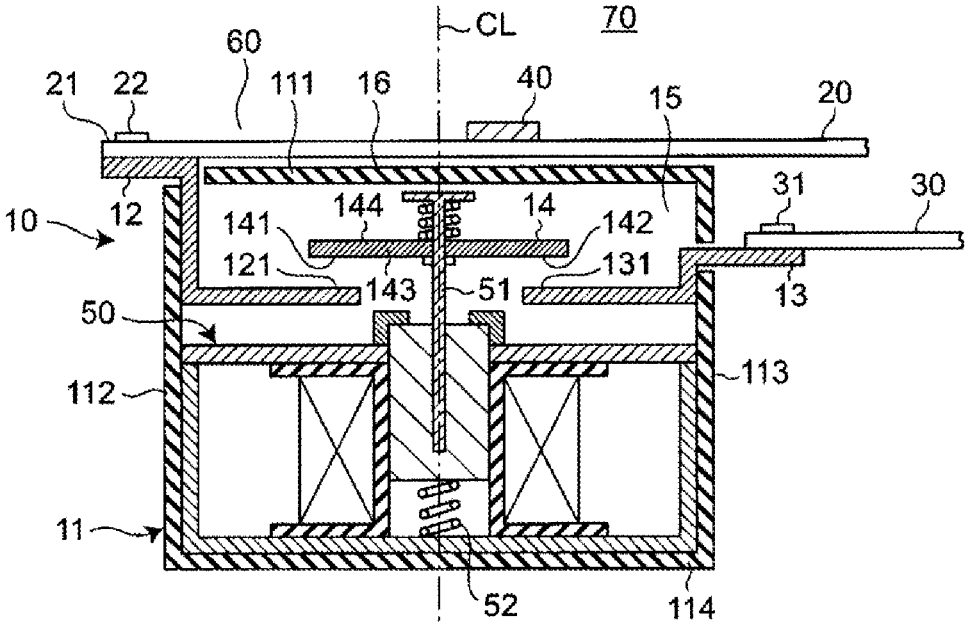
FIG. 3 is a cross-sectional view taken along line III-Ill in FIG. 2.

As shown in FIG. 3, the electromagnetic relay 10 includes the housing 11 having a compartment 15 in an inside of the housing 11, a first fixed contact side terminal 12 and a second fixed contact side terminal 13, both of which are fixed to the housing 11, and a movable touch piece 14 having a plate shape and arranged in the compartment 15. The movable touch piece 14 is provided with a first movable contact portion 141 and a second movable contact portion 142 arranged with a gap therebetween.

As shown in FIG. 3, the housing 11 has a rectangular parallelepiped box shape, and includes a first wall 111 having a bus bar installation surface 16 on an outer surface (i.e., an upper surface in FIG. 3), and a pair of side walls (i.e., a second wall 112 being a one end side wall and a third wall 113 being an other end side wall) orthogonal to the bus bar installation surface 16 and facing in an arrangement direction connecting the first movable contact portion 141 and the second movable contact portion 142 (i.e., the left-right direction in FIG. 3).

As shown in FIG. 3, the first fixed contact side terminal 12 has a plate shape, is fixed to the first wall 111 of the housing 11, and extends from the outside of the housing 11 to the compartment 15. A one end of the first fixed contact side terminal 12 on the outer side of the housing 11 (i.e., the left end in FIG. 3) is positioned on the side of the bus bar installation surface 16 in a direction orthogonal to the bus bar installation surface 16 and is also on the one end side in the arrangement direction (i.e., on the left end side in FIG. 3), and extends in a direction away from the second wall 112 of the housing 11 along the bus bar installation surface 16. Further, at an other end of the first fixed contact side terminal 12 on the side of the compartment 15 (i.e., the right end in FIG. 3), a first fixed contact portion 121 arranged in the compartment 15 is provided.

As shown in FIG. 3, the second fixed contact side terminal 13 is plate-shaped, and is fixed to the third wall 113 of the housing 11 electrically independently of the first fixed contact side terminal 12, and also extends from the outside of the housing 11 to the compartment 15. At a one end of the second fixed contact side terminal 13 on the side of the compartment 15 (i.e., the left end in FIG. 3), a second fixed contact portion 131 arranged in the compartment 15 is provided. Further, an other end of the second fixed contact side terminal 13 on the outer side of the housing 11 (i.e., the right end in FIG. 3) extends in a direction away from the third wall 113 along the arrangement direction.

As shown in FIG. 3, the movable touch piece 14 has a substantially rectangular plate shape, and is arranged between an end of the first fixed contact side terminal 12 on the side of the compartment 15 and an end of the second fixed contact side terminal 13 on the side of the compartment 15, and the first wall 111 of the housing 11. The movable touch piece 14 includes a first plate surface 143 facing the end of the first fixed contact side terminal 12 on the side of the compartment 15 and the end of the second fixed contact side terminal 13 on the side of the compartment 15, and a second plate surface 144 facing the first wall 111 of the housing 11. Further, on the first plate surface 143, there are provided the first movable contact portion 141 arranged to face the first fixed contact portion 121 and the second movable contact portion 142 arranged to face the second fixed contact portion 131. In other words, the bus bar installation surface 16 is provided on the outer periphery of the housing 11 and on the side of the second plate surface 144 of the movable touch piece 14.

In addition, the movable touch piece 14 is provided movably in a contact/separation direction (i.e. the vertical direction in FIG. 3) in which each of the first movable contact portion 141 and the second movable contact portion 142 is in contact with or separated from the first fixed contact portion 121 and the second fixed contact portion 131, respectively.

Specifically, an electromagnet unit 50 is arranged on the side of a fourth wall 114 facing the first wall 111 in the contact/separation direction of the compartment 15. The movable touch piece 14 is connected to the electromagnet unit 50 via a movable shaft 51 connected at substantially the center in the longitudinal direction of the movable touch piece, and is biased toward the side of the first wall 111 in the contact/separation direction by a return spring 52 via the movable shaft 51.

When the electromagnet unit 50 is in a non-excited state, the movable touch piece 14 is positioned on the side of the first wall 111 in the contact/separation direction by biasing force of the return spring 52 as shown in FIG. 3, and each of the first movable contact portion 141 and the second movable contact portion 142 is separated from the first fixed contact portion 121 and the second fixed contact portion 131, respectively. When the non-excited electromagnet unit 50 is excited, the movable touch piece 14 moves against the biasing force of the return spring 52 by the electromagnet unit 50 from the side of the first wall 111 toward the side of the fourth wall 114 in the contact/separation direction, and each of the first movable contact portion 141 and the second movable contact portion 142 is brought into contact with the first fixed contact portion 121 and the second fixed contact portion 131, respectively.

As shown in FIG. 2, the first bus bar 20 has a substantially rectangular plate shape and is arranged so as to extend on the outside of the housing 11 in the arrangement direction along the bus bar installation surface 16 and is also arranged such that a plate surface thereof faces the bus bar installation surface 16. Thus, at least a portion of the first bus bar 20 overlaps with the movable touch piece 14 when viewed from the contact/separation direction (see FIGS. 3 and 4).

Further, the first bus bar 20 is connected at a one end in the arrangement direction of the first bus bar 20 (i.e., the left end of FIG. 2), to the one end of the first fixed contact side terminal 12 on the outer side of the housing 11, at a connection point 21 on the one end side of the bus bar installation surface 16 in the arrangement direction (i.e., the left end side of FIG. 2). The first bus bar 20 and the first fixed contact side terminal 12 are fixed with a screw 22 as an example.

As shown in FIG. 2, the second bus bar 30 has a substantially rectangular plate shape and is connected to the second fixed contact side terminal 13 on the outside of the housing 11 electrically independently of the first bus bar 20. The second bus bar 30 extends in the arrangement direction along the first bus bar 20, and a plate surface thereof is arranged so as to face the plate surface of the first bus bar 20. That is, the first bus bar 20 and the second bus bar 30 are arranged so that the plate surfaces face each other in the contact/separation direction.

In addition, the second bus bar 30 is connected at a one end thereof in the arrangement direction (i.e., the left end in FIG. 2) to the other end of the second fixed contact side terminal 13 on the outer side of the housing 11. The second bus bar 30 and the second fixed contact side terminal 13 are fixed with a screw 31 as an example.

During energization (that is, when each of the first movable contact portion 141 and the second movable contact portion 142 is in contact with the first fixed contact portion 121 and the second fixed contact portion 131, respectively), currents flow in opposite directions to each other between the first bus bar 20, and the movable touch piece 14 and the second bus bar 30.

As shown in FIG. 3, the bus bar position restrictor 40 is arranged on the bus bar installation surface 16 with a gap 60 in the arrangement direction from the connection point 21 between the first fixed contact side terminal 12 and the first bus bar 20, restricts a position of the first bus bar 20 in the contact/separation direction and in a direction away from the bus bar installation surface 16, and maintains a state in which the first bus bar 20 extends in the arrangement direction along the bus bar installation surface 16.

Figure 4:
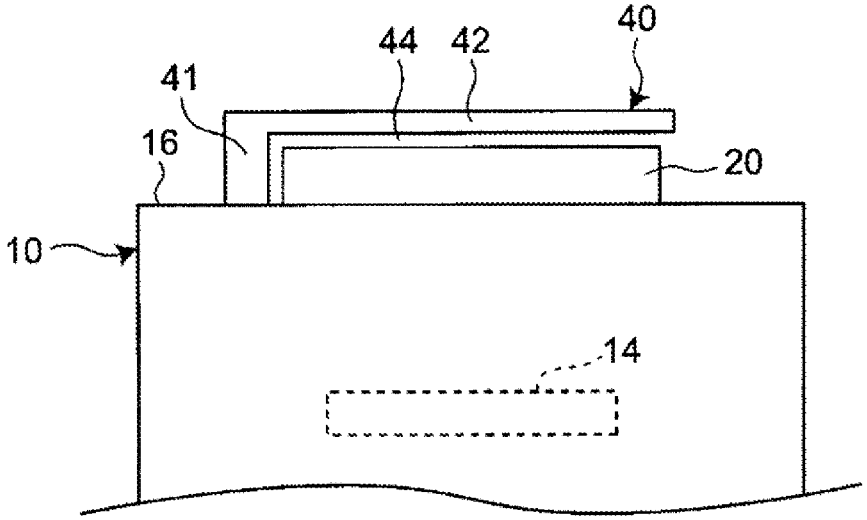
FIG. 4 is a side view as seen from a direction of an arrow IV in FIG. 2.

Specifically, as shown in FIG. 4, the bus bar position restrictor 40 has a substantially L shape when viewed from the arrangement direction (i.e., the paper surface penetration direction in FIG. 4), and on the bus bar installation surface 16, the bus bar position restrictor 40 is arranged in a region 70 farther from the connection point 21 in the arrangement direction than a center CL of the movable touch piece 14 in the arrangement direction. As shown in FIG. 4, the bus bar position restrictor 40 includes a first member 41 extending in the direction away from the bus bar installation surface 16 along the contact/separation direction from the bus bar installation surface 16 (i.e., upward in FIG. 4), and a second member 42 extending from an end of the first member 41 farther from the bus bar installation surface 16 and in a direction orthogonal to the contact/separation direction and the arrangement direction along the bus bar installation surface 16 (i.e., rightward in FIG. 4). The first bus bar 20 is sandwiched between the bus bar installation surface 16 and the second member 42 of the bus bar position restrictor 40, and the position thereof is restricted in the contact/separation direction and in the direction away from the bus bar installation surface 16 (i.e., upward in FIG. 4).

In FIG. 4, although a gap 44 is formed between the first bus bar 20 and the second member 42, the gap 44 may not be provided. That is, the first bus bar 20 may be configured to be clamped between the bus bar installation surface 16 and the second member 42 of the bus bar position restrictor 40.

In the connection unit 1, the bus bar position restrictor 40 is provided on the bus bar installation surface 16. The bus bar position restrictor 40 is arranged with a gap 60 in the arrangement direction from the connection point 21 at which a one end of the first bus bar 20 in the arrangement direction is connected to the first fixed contact side terminal 12, and restricts the position of the first bus bar 20 in the contact/separation direction and in the direction away from the bus bar installation surface 16. This bus bar position restrictor 40 can maintain the state in which the first bus bar 20 extends substantially linearly in the arrangement direction along the bus bar installation surface 16. Accordingly, the first bus bar 20 can be suppressed from being deformed in the contact/separation direction and in the direction away from the bus bar installation surface 16 by the electromagnetic repulsive force generated during energization due to the currents flowing in the opposite directions to each other through the movable touch piece 14 and the first bus bar 20. As a result, reduction in the electromagnetic repulsive force generated between the movable touch piece 14 and the first bus bar 20 due to the deformation of the first bus bar 20 can be suppressed, and the contact reliability of the connection unit 1 can be improved.

Further, the bus bar position restrictor 40 is arranged on the bus bar installation surface 16 in the region 70 farther from the connection point 21 in the arrangement direction than the center CL of the movable touch piece 14 in the arrangement direction. By arranging the bus bar position restrictor 40 in this manner, the state in which the first bus bar 20 extends substantially linearly in the arrangement direction along the bus bar installation surface 16 can be more reliably maintained. Accordingly, the first bus bar 20 can be more reliably suppressed from being deformed in the contact/separation direction and in the direction away from the bus bar installation surface 16 by the electromagnetic repulsive force generated during energization due to the currents flowing in the opposite directions to each other through the movable touch piece 14 and the first bus bar 20.

The bus bar position restrictor 40 also has a first member 41 extending in the direction away from the bus bar installation surface 16 along the contact/separation direction from the bus bar installation surface 16, and a second member 42 extending from the end of the first member 41 farther from the bus bar installation surface 16 and in the direction orthogonal to the contact/separation direction and the arrangement direction along the bus bar installation surface 16. Additionally, the first bus bar 20 is arranged between the bus bar installation surface 16 and the second member 42. Thereby, the state in which the first bus bar 20 extends substantially linearly in the arrangement direction along the bus bar installation surface 16 can be more reliably maintained with a simple configuration. Accordingly, the first bus bar 20 can be more reliably suppressed from being deformed in the contact/separation direction and in the direction away from the bus bar installation surface 16 by the electromagnetic repulsive force generated during energization due to the currents flowing in the opposite directions to each other through the movable touch piece 14 and the first bus bar 20.

Note that the bus bar position restrictor 40 can be arranged at any position on the bus bar installation surface 16 as long as the bus bar position restrictor 40 is arranged in the region 70 farther from the connection point 21 in the arrangement direction than the center CL of the movable touch piece 14 in the arrangement direction. The farther away the bus bar position restrictor 40 is from the connection point 21, the more reliably the state can be maintained in which the first bus bar 20 extends in the arrangement direction along the bus bar installation surface 16.

Further, the bus bar position restrictor 40 may be formed integrally with the housing 11 or may be formed separately from the housing 11.

In addition, the bus bar position restrictor 40 is arranged on the bus bar installation surface 16 in the region 70 farther from the connection point 21 in the arrangement direction than the center CL of the movable touch piece 14 in the arrangement direction. However, the configuration is not limited thereto. That is, the bus bar position restrictor 40 may be arranged on the bus bar installation surface 16 as long as the bus bar position restrictor 40 is arranged with the gap 60 from the connection point 21 in the arrangement direction.

Figure 5:
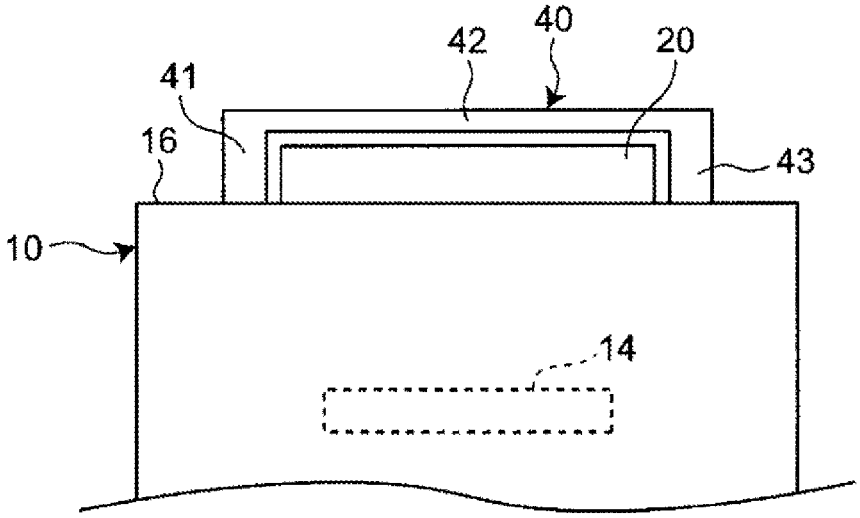
FIG. 5 is a side view seen from the direction of the arrow IV in FIG. 2, showing a modification example of the connection unit in FIG. 2.

Further, the bus bar position restrictor 40 is not limited to the one that is constituted of the first member 41 and the second member 42 and has the substantially L shape when viewed from the arrangement direction. For example, as shown in FIG. 5, the bus bar position restrictor 40 may be constituted of the first member 41 and the second member 42, and a third member 43 so as to form a substantially U shape when viewed from the arrangement direction. Here, the third member 43 is connected to an end of the second member 42 in the extending direction opposite to the end that is connected to the first member 41 and extends from the second member 42 in a direction approaching toward the bus bar installation surface 16 along the contact/separation direction. Further, although not shown, a fastening member may be used, such as a screw that penetrates the first bus bar 20 and can be fixed to the housing 11.

Further, the bus bar position restrictor 40 may be a conductor or an insulator.

The first fixed contact side terminal 12 is not limited to the one that is fixed to the first wall 111 of the housing 11, but may be fixed to the second wall 112, for example. Further, the second fixed contact side terminal 13 is not limited to the one that is fixed to the third wall 113, but may be fixed to the first wall 111, for example.

The housing 11 is not limited to a rectangular parallelepiped shape, but may be other shapes such as a cylindrical shape.

The first bus bar 20 and the second bus bar 30 are not limited to a plate shape, and may be other shapes such as a rod shape.

Second Embodiment

Figure 6:
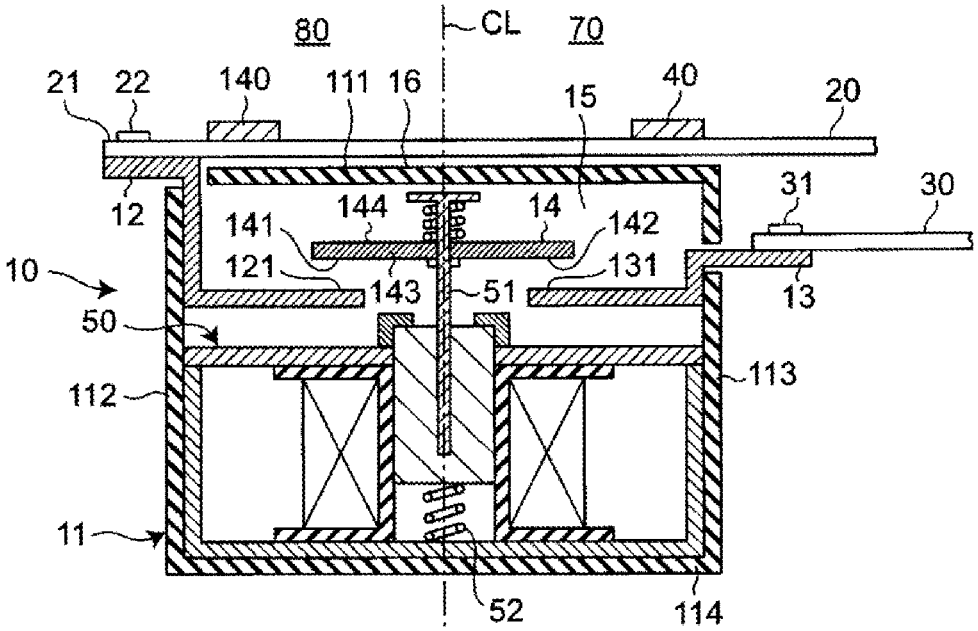
FIG. 6 is a perspective view of a connection unit according to a second embodiment of the present disclosure.

As shown in FIG. 6, a connection unit 1 of a second embodiment of the present disclosure is different from that of the first embodiment in that the connection unit 1 includes, in addition to the bus bar position restrictor 40 (in this embodiment, referred to as a first bus bar first position restrictor 40), a bus bar position restrictor 140 (in this embodiment, referred to as a first bus bar second position restrictor 140).

In the second embodiment, the same parts as those in the first embodiment are denoted by the same reference numerals, and the description thereof is omitted.

As shown in FIG. 6, the first bus bar second position restrictor 140 is arranged in a different region on the bus bar installation surface 16 from the first bus bar first position restrictor 40, and restricts the position of the first bus bar 20 in the contact/separation direction and in the direction away from the bus bar installation surface 16.

Specifically, the first bus bar second position restrictor 140 is arranged on the bus bar installation surface 16 in a region 80 closer to the connection point 21 in the arrangement direction than the center CL of the movable touch piece 14 in the arrangement direction. In the second embodiment, the first bus bar first position restrictor 40 is arranged at the end on the bus bar installation surface 16 on the side of the third wall 113 in the arrangement direction, and the first bus bar second position restrictor 140 is arranged at the end on the bus bar installation surface 16 on the side of the second wall 112 in the arrangement direction.

The first bus bar second position restrictor 140 has the same configuration as the first bus bar first position restrictor 40. For this reason, the description of the first bus bar first position restrictor 40 is used for the description of the first bus bar second position restrictor 140.

As described above, in the connection unit 1 of the second embodiment, the first bus bar first position restrictor 40 is arranged on the bus bar installation surface 16 in the region 70 farther from the connection point 21 in the arrangement direction than the center CL of the movable touch piece 14 in the arrangement direction, and the first bus bar second position restrictor 140 is arranged on the bus bar installation surface 16 in the region 80 closer to the connection point 21 in the arrangement direction than the center CL of the movable touch piece 14 in the arrangement direction. The first bus bar first position restrictor 40 and the first bus bar second position restrictor 140 allow the state to be more reliably maintained in which the first bus bar 20 extends substantially linearly in the arrangement direction along the bus bar installation surface 16. Therefore, the first bus bar 20 can be more reliably suppressed from being deformed in the contact/separation direction and in the direction away from the bus bar installation surface 16 by the electromagnetic repulsive force generated during energization between the movable touch piece 14 and the first bus bar 20. As a result, reduction in the electromagnetic repulsive force generated between the movable touch piece 14 and the first bus bar 20 due to the deformation of the first bus bar 20 can be suppressed, and the contact reliability of the connection unit 1 can be improved.

The first bus bar second position restrictor 140 can be arranged at any position on the bus bar installation surface 16 as long as the first bus bar second position restrictor 140 is in the region 80 closer to the connection point 21 in the arrangement direction than the center CL of the movable touch piece 14 in the arrangement direction.

Further, the first bus bar second position restrictor 140 may be a conductor or an insulator.

Third Embodiment

Figure 7:
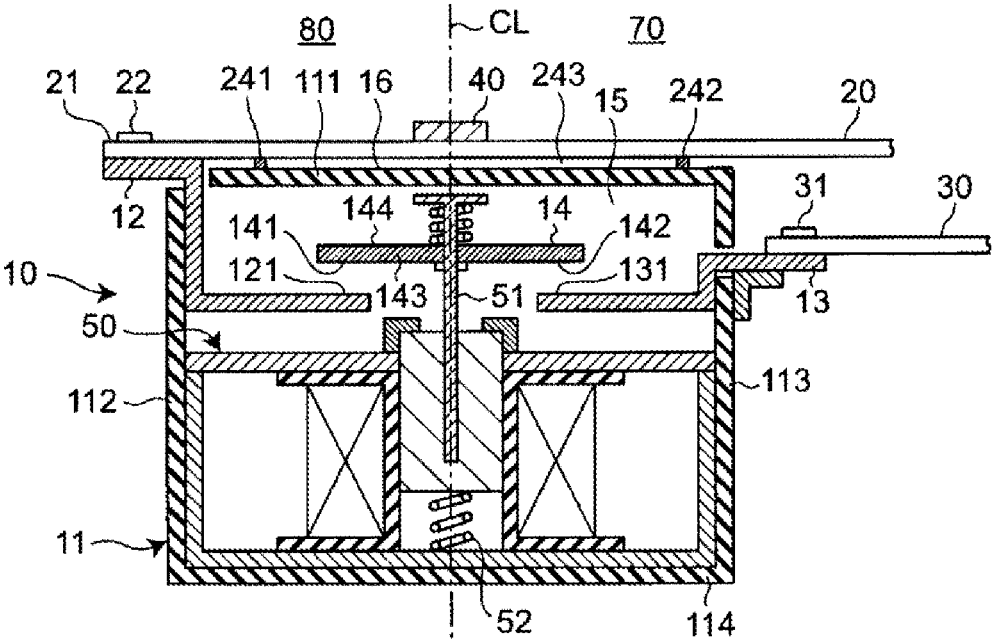
FIG. 7 is a perspective view of a connection unit according to a third embodiment of the present disclosure.

As shown in FIG. 7, a connection unit 1 of a third embodiment of the present disclosure is different from that of the first embodiment in that the connection unit 1 includes a pair of protrusions 241, 242 configured to sandwich the first bus bar 20 together with the bus bar position restrictor 40.

In the third embodiment, the same parts as those in the first embodiment are denoted by the same reference numerals, and description thereof is omitted.

In the connection unit 1 of the third embodiment, as shown in FIG. 7, the bus bar position restrictor 40 is arranged on the bus bar installation surface 16 at a center portion in the arrangement direction of the movable touch piece 14 (i.e., near the center CL of the movable touch pieces 14 in the arrangement direction). In addition, one of the pair of protrusions 241, 242 is arranged on the bus bar installation surface 16 in the region 70 farther from the connection point 21 in the arrangement direction than the center CL of the movable touch piece 14 in the arrangement direction, and the other of the pair of protrusions 241, 242 is arranged on the bus bar installation surface 16 in the region 80 closer to the connection point 21 in the arrangement direction than the center CL of the movable touch piece 14 in the arrangement direction. A gap 243 is formed between the first bus bar 20 and the bus bar installation surface 16 by the pair of protrusions 241, 242.

As described above, the connection unit 1 of the third embodiment further includes the pair of protrusions 241, 242 provided on the bus bar installation surface 16 and configured to sandwich the first bus bar 20 together with the bus bar position restrictor 40. Further, on the bus bar installation surface 16, the bus bar position restrictor 40 is arranged at the center portion of the movable touch piece 14 in the arrangement direction, and one of the pair of protrusions 241, 242 is arranged in the region 70 farther from the connection point 21 in the arrangement direction than the center CL of the movable touch piece 14 in the arrangement direction, and the other of the pair of protrusions 241, 242 is arranged in the region 80 closer to the connection point 21 in the arrangement direction than the center CL of the movable touch piece 14 in the arrangement direction. As a result, the state in which the first bus bar 20 extends in the arrangement direction along the bus bar installation surface 16 can be more reliably maintained, and therefore, the first bus bar 20 can be more reliably suppressed from being deformed in the contact/separation direction and in the direction away from the bus bar installation surface 16 by the electromagnetic repulsive force generated during energization between the movable touch piece 14 and the first bus bar 20. As a result, reduction in the electromagnetic repulsive force generated between the movable touch piece 14 and the first bus bar 20 due to the deformation of the first bus bar 20 can be suppressed, and the contact reliability of the connection unit 1 can be improved.

Further, because the first bus bar 20 is sandwiched between the bus bar position restrictor 40 and the pair of protrusions 241, 242, positional accuracy or pinching accuracy of the first bus bar 20 can be improved.

In addition, because the gap 243 is formed between the first bus bar 20 and the bus bar installation surface 16 by the pair of protrusions 241, 242, heat dissipation of the first bus bar 20 can be improved to reduce the heat transmitted from the first bus bar 20 to the electromagnetic relay 10.

Each of the pair of protrusions 241, 242 can be arranged at any position as long as each protrusion is in the region 70 farther from the connection point 21 and the region 80 close to the connection point 21, respectively.

Each of the pair of protrusions 241, 242 may be formed integrally with the housing 11 or may be formed separately from the housing 11.

Each of the pair of protrusions 241, 242 may be a conductor or an insulator.

Fourth Embodiment

Figure 8:
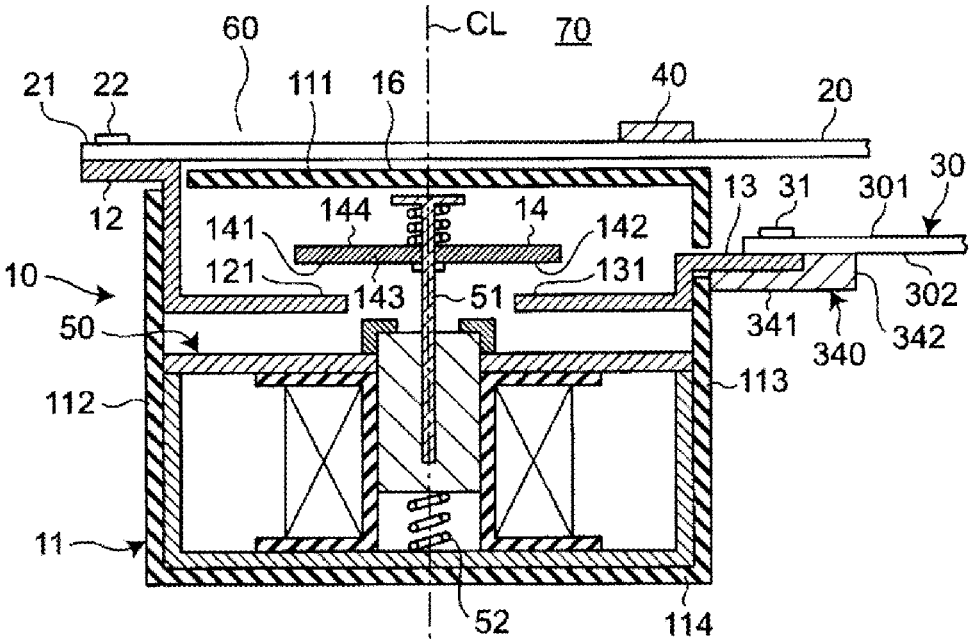
FIG. 8 is a perspective view of a connection unit according to a fourth embodiment of the present disclosure.

As shown in FIG. 8, a connection unit 1 according to a fourth embodiment of the present disclosure is different from that of the first embodiment in that the connection unit 1 includes, in addition to the bus bar position restrictor 40 (referred to as the first bus bar position restrictor 40 in this embodiment), a second bus bar position restrictor 340 that restricts a position of the second bus bar 30 in the contact/separation direction and in a direction away from the first bus bar 20.

In the fourth embodiment, the same parts as those in the first embodiment are denoted by the same reference numerals, and the description thereof is omitted.

As shown in FIG. 8, the second bus bar position restrictor 340 is provided on the side of a plate surface 302 of the second bus bar 30 opposite to a plate surface 301 facing the first bus bar 20. The second bus bar position restrictor 340 also restricts the position of the second bus bar 30 in the contact/separation direction and in the direction away from the first bus bar 20 (i.e., downward in FIG. 8), and maintains the state in which the second bus bar 30 extends in the arrangement direction along the bus bar installation surface 16 and in a direction away from the housing 11.

Specifically, the second bus bar position restrictor 340 is constituted of a fixed portion 341 having a substantially rectangular shape and fixed to a surface of the second fixed contact side terminal 13 opposite to the side to which the second bus bar 30 is attached in the contact/separation direction, and a position restricting portion 342 provided so as to protrude from a leading end portion in the extending direction of the fixed portion 341 toward the second bus bar 30. The position restricting portion 342 restricts the position of the second bus bar 30 in the contact/separation direction and in the direction away from the first bus bar 20.

Thus, in the connection unit 1 of the fourth embodiment, the second bus bar position restrictor 340 is further provided. The second bus bar position restrictor 340 is provided on the plate surface of the second bus bar 30 on the side opposite to the plate surface facing the first bus bar 20, and restricts the position of the second bus bar 30 in the contact/separation direction and in the direction away from the first bus bar 20. Because the second bus bar position restrictor 340 can maintain the state of the second bus bar 30 extending in the arrangement direction along the bus bar installation surface 16, the occurrence of a defect in the electromagnetic relay 10 can be suppressed, the defect being deformation of the second bus bar 30 in the contact/separation direction and in the direction away from the first bus bar 20.

Further, the second bus bar position restrictor 340 may be a conductor or an insulator.

Fifth Embodiment

Figure 9:
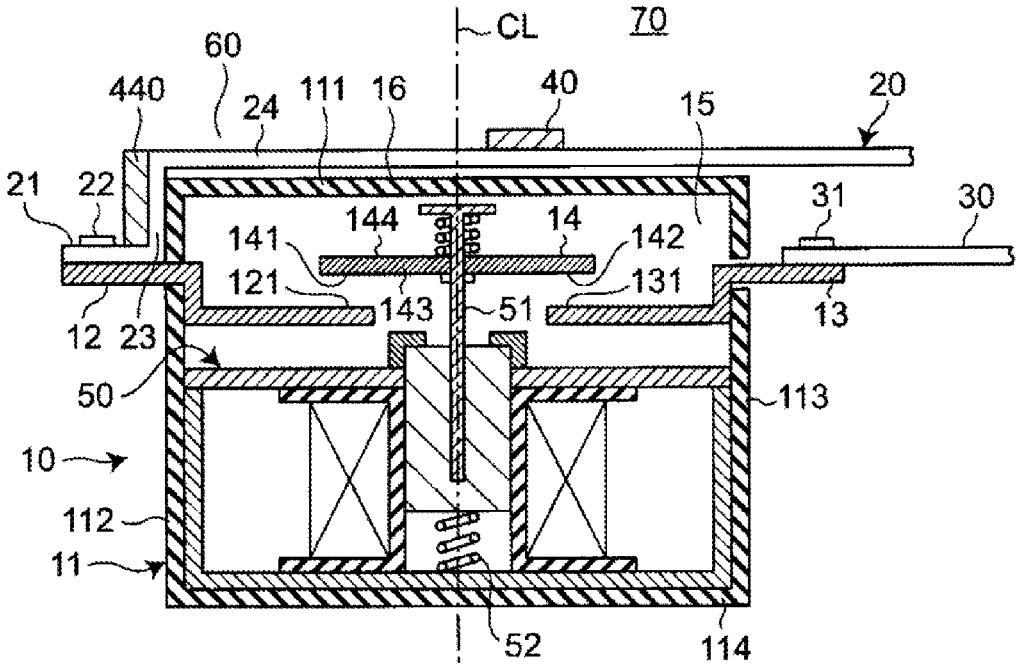
FIG. 9 is a perspective view of a connection unit according to a fifth embodiment of the present disclosure.

As shown in FIG. 9, a connection unit 1 of a fifth embodiment of the present disclosure is different from that of the first embodiment in that the first fixed contact side terminal 12 is fixed to the second wall 112 of the housing 11, the first bus bar 20 is constituted of a vertical member 23 and a cross member 24, and the connection unit 1 further includes an auxiliary bus bar position restrictor 440 that restricts the position of the vertical member 23 in the arrangement direction of the housing 11 and in the direction away from the second wall 112 of the housing 11.

In the fifth embodiment, the same parts as those in the first embodiment are denoted by the same reference numerals, and description thereof is omitted.

As shown in FIG. 9, the electromagnetic relay 10 of the fifth embodiment is arranged symmetrically with respect to the center CL of the movable touch piece 14 in the arrangement direction when viewed from a width direction intersecting the contact/separation direction and the arrangement direction (that is, the paper surface penetration direction in FIG. 9). That is, the first fixed contact side terminal 12 and the second fixed contact side terminal 13 have a symmetrical shape in the width direction with respect to the center CL of the movable touch piece 14 in the arrangement direction.

As shown in FIG. 9, the vertical member 23 of the first bus bar 20 extends toward the bus bar installation surface 16 along the second wall 112. The auxiliary bus bar position restrictor 440 extends along the extending direction of the vertical member 23, and is provided over the entire extending direction of the vertical member. The auxiliary bus bar position restrictor 440 restricts a position of the vertical member 23 in the arrangement direction of the housing 11 and in the direction away from the second wall 112 of the housing 11. Further, the cross member 24 of the first bus bar 20 extends from the vertical member 23 along the bus bar installation surface 16 in the arrangement direction. The bus bar position restrictor 40 restricts a position of the cross member 24 in the contact/separation direction and in the direction away from the bus bar installation surface 16.

As described above, in the connection unit 1 of the fifth embodiment, the first bus bar 20 is constituted of the vertical member 23 extending along the second wall 112 toward the bus bar installation surface 16 and the cross member 24 extending from the vertical member 23 in the arrangement direction along the bus bar installation surface 16. The connection unit 1 further includes the auxiliary bus bar position restrictor 440 that restricts the position of the vertical member 23 in the arrangement direction of the housing 11 and in the direction away from the second wall 112 of the housing 11. This auxiliary bus bar position restrictor 440 can more reliably maintain the state in which the first bus bar 20 extends in the arrangement direction along the bus bar installation surface 16, and therefore, the first bus bar 20 can be more reliably suppressed from being deformed in the contact/separation direction and in the direction away from the bus bar installation surface 16 by the electromagnetic repulsive force generated during energization between the movable touch piece 14 and the first bus bar 20. As a result, reduction in the electromagnetic repulsive force generated between the movable touch piece 14 and the first bus bar 20 due to the deformation of the first bus bar 20 can be suppressed, and the contact reliability of the connection unit 1 can be improved.

Note that the auxiliary bus bar position restrictor 440 is not limited to the one that is provided over the entire contact/separation direction of the vertical member 23, but for example, the auxiliary bus bar position restrictor 440 can be arranged only at the end of the second wall 112 closer to the bus bar installation surface 16. Accordingly, as compared to the case in which the auxiliary bus bar position restrictor 440 is provided over the entire contact/separation direction of the vertical member 23, an amount of material used to form the auxiliary bus bar position restrictor 440 can be suppressed.

Further, the auxiliary bus bar position restrictor 440 may be a conductor or an insulator.

Although various embodiments in the present disclosure have been described in detail above with reference to the drawings, finally, various aspects of the present disclosure are described. In the following description, the reference numerals are also given as an example.

The connection unit 1 of the first aspect of the present disclosure is the connection unit 1 including the electromagnetic relay 10 including: the housing 11 having the compartment 15 in an inside of the housing 11; the first fixed contact side terminal 12 fixed to the housing 11, and having the first fixed contact portion 121 extending from the outside of the housing 11 to the compartment 15 and arranged in the compartment 15; the second fixed contact side terminal 13 fixed to the housing 11 electrically independently of the first fixed contact side terminal 12, and having the second fixed contact portion 131 extending from the outside of the housing 11 to the compartment 15 and arranged in the compartment 15; and the movable touch piece 14 having a plate shape and arranged in the compartment 15, having the first movable contact portion 141 arranged to face the first fixed contact portion 121 and the second movable contact portion 142 arranged to face the second fixed contact portion 131, and in which each of the first movable contact portion 141 and the second movable contact portion 142 is movable in the contact/separation direction in contact with or separated from the first fixed contact portion 121 and the second fixed contact portion 131, respectively, the first fixed contact side terminal 12 having the end on the outer side of the housing 11, the end being positioned on the side of the bus bar installation surface 16 in the contact/separation direction and on the one end side in the arrangement direction connecting the first movable contact portion 141 and the second movable contact portion 142, the housing 11 having the bus bar installation surface 16 provided on the outer periphery of the housing 11 and on the side of the second plate surface 144 of the movable touch piece 14, the second plate surface 144 being opposite in the contact/separation direction to the first plate surface 143 on which the first movable contact portion 141 and the second movable contact portion 142 of the movable touch piece 14 are provided, the connection unit 1 further including: the first bus bar 20 extending on the outside of the housing 11 in the arrangement direction along the bus bar installation surface 16, overlapping with the movable touch piece 14 in at least a portion of the first bus bar 20 viewed from the contact/separation direction, and also connected to the first fixed contact side terminal 12 at the one end in the arrangement direction, at the connection point 21 on the one end side of the bus bar installation surface 16 in the arrangement direction; the second bus bar 30 connected to the second fixed contact side terminal 13 on the outside of the housing 11 electrically independently of the first bus bar 20; and the bus bar position restrictor 40 arranged on the bus bar installation surface 16 with the gap 60 in the arrangement direction from the connection point 21, and configured to restrict the position of the first bus bar 20 in the contact/separation direction and in the direction away from the bus bar installation surface 16.

In other words, the connection unit 1 of the first aspect of the present disclosure is the connection unit 1 including the electromagnetic relay 10 including: the housing 11 having the compartment 15 in an inside of the housing 11; the first fixed contact side terminal 12 fixed to the housing 11, and having the first fixed contact portion 121 extending from the outside of the housing 11 to the compartment 15 and arranged in the compartment 15; the second fixed contact side terminal 13 fixed to the housing 11 electrically independently of the first fixed contact side terminal 12, and having the second fixed contact portion 131 extending from the outside of the housing 11 to the compartment 15 and arranged in the compartment 15; and the movable touch piece 14 having a plate shape and arranged in the compartment 15, having the first movable contact portion 141 arranged to face the first fixed contact portion 121 and the second movable contact portion 142 arranged to face the second fixed contact portion 131, and in which each of the first movable contact portion 141 and the second movable contact portion 142 is movable in the contact/separation direction in contact with or separated from the first fixed contact portion 121 and the second fixed contact portion 131, respectively, the housing 11 having the bus bar installation surface 16 provided on the outer periphery of the housing 11 and on the side of the second plate surface 144 of the movable touch piece 14, the second plate surface 144 being opposite in the contact/separation direction to the first plate surface 143 on which the first movable contact portion 141 and the second movable contact portion 142 of the movable touch piece 14 are provided; and the first fixed contact side terminal 12 having the end on the outer side of the housing 11, the end being positioned on the side of the bus bar installation surface 16 in the contact/separation direction and on the one end side in the arrangement direction connecting the first movable contact portion 141 and the second movable contact portion 142, the connection unit 1 further including: the first bus bar 20 extending on the outside of the housing 11 in the arrangement direction along the bus bar installation surface 16, overlapping with the movable touch piece 14 in at least a portion of the first bus bar 20 viewed from the contact/separation direction, and also connected to the first fixed contact side terminal 12 at the one end in the arrangement direction, at the connection point 21 on the one end side of the bus bar installation surface 16 in the arrangement direction; the second bus bar 30 connected to the second fixed contact side terminal 13 on the outside of the housing 11 electrically independently of the first bus bar 20; and the bus bar position restrictor 40 arranged on the bus bar installation surface 16 with the gap 60 in the arrangement direction from the connection point 21, and configured to restrict the position of the first bus bar 20 in the contact/separation direction and in the direction away from the bus bar installation surface 16.

According to the connection unit 1 of the first aspect, the bus bar position restrictor 40 can maintain the state in which the first bus bar 20 extends substantially linearly in the arrangement direction along the bus bar installation surface 16, and therefore, the first bus bar 20 can be suppressed from being deformed in the contact/separation direction and in the direction away from the bus bar installation surface 16 by the electromagnetic repulsive force generated during energization due to the currents flowing in the opposite directions to each other through the movable touch piece 14 and the first bus bar 20. As a result, reduction in the electromagnetic repulsive force generated between the movable touch piece 14 and the first bus bar 20 due to the deformation of the first bus bar 20 can be suppressed, and the contact reliability of the connection unit 1 can be improved.

In the connection unit 1 of the second aspect of the present disclosure, the bus bar position restrictor 40 is arranged on the bus bar installation surface 16 in the region 70 farther from the connection point 21 in the arrangement direction than the center CL of the movable touch piece 14 in the arrangement direction.

According to the connection unit 1 of the second aspect, the state in which the first bus bar 20 extends substantially linearly in the arrangement direction along the bus bar installation surface 16 can be more reliably maintained, and therefore, the first bus bar 20 can be more reliably suppressed from being deformed in the contact/separation direction and in the direction away from the bus bar installation surface 16 by the electromagnetic repulsive force generated during energization due to the currents flowing in the opposite directions to each other through the movable touch piece 14 and the first bus bar 20.

The connection unit 1 of the third aspect of the present disclosure further includes, while the bus bar position restrictor 40 is referred to as the first bus bar first position restrictor 40, the first bus bar second position restrictor 140 arranged in the different region on the bus bar installation surface 16 to the first bus bar position restrictor 40, and configured to restrict the position of the first bus bar 20 in the contact/separation direction and in the direction away from the bus bar installation surface 16.

In the connection unit 1, the first bus bar first position restrictor 40 is arranged on the bus bar installation surface 16 in the region 70 farther from the connection point 21 in the arrangement direction than the center CL of the movable touch piece 14 in the arrangement direction, and the first bus bar second position restrictor 140 is arranged on the bus bar installation surface 16 in the region 80 closer to the connection point 21 in the arrangement direction than the center CL of the movable touch piece 14 in the arrangement direction.

According to the connection unit 1 of the third aspect, the state in which the first bus bar 20 extends substantially linearly in the arrangement direction along the bus bar installation surface 16 can be more reliably maintained, and therefore, the first bus bar 20 can be more reliably suppressed from being deformed in the contact/separation direction and in the direction away from the bus bar installation surface 16 by the electromagnetic repulsive force generated during energization between the movable touch piece 14 and the first bus bar 20. As a result, reduction in the electromagnetic repulsive force generated between the movable touch piece 14 and the first bus bar 20 due to the deformation of the first bus bar 20 can be suppressed, and the contact reliability of the connection unit 1 can be improved.

The connection unit 1 of the fourth aspect of the present disclosure further includes the pair of protrusions 241, 242 provided on the bus bar installation surface 16 of the housing 11 and also configured to sandwich the first bus bar 20 together with the bus bar position restrictor 40.

In the connection unit 1, the bus bar position restrictor 40 is arranged on the bus bar installation surface 16 at the center portion of the movable touch piece 14 in the arrangement direction, and one of the pair of protrusions 241, 242 is arranged in the region 70 farther from the connection point 21 in the arrangement direction than the center CL of the movable touch piece 14 in the arrangement direction, and the other of the pair of protrusions 241, 242 is arranged in the region 80 closer to the connection point 21 in the arrangement direction than the center CL of the movable touch piece 14 in the arrangement direction.

According to the connection unit 1 of the fourth aspect, the state in which the first bus bar 20 extends in the arrangement direction along the bus bar installation surface 16 can be more reliably maintained, and therefore, the first bus bar 20 can be more reliably suppressed from being deformed in the contact/separation direction and in the direction away from the bus bar installation surface 16 by the electromagnetic repulsive force generated during energization between the movable touch piece 14 and the first bus bar 20. As a result, reduction in the electromagnetic repulsive force generated between the movable touch piece 14 and the first bus bar 20 due to the deformation of the first bus bar 20 can be suppressed, and the contact reliability of the connection unit 1 can be improved.

In the connection unit 1 of the fifth aspect of the present disclosure, the housing 11 has a rectangular parallelepiped shape, the second fixed contact side terminal 13 is fixed to the other end side wall 113, the other end side wall 113 being orthogonal to the bus bar installation surface 16 of the housing 11 and provided on the other end side of the bus bar installation surface 16 in the arrangement direction, the second bus bar 30 extends in the arrangement direction along the first bus bar 20, the first bus bar 20 and the second bus bar 30 each have a plate shape, and the plate surfaces thereof are arranged so as to face each other in the contact/separation direction.

The connection unit 1 further includes the second bus bar position restrictor 340 provided on the side of the plate surface 302 of the second bus bar 30 opposite to the plate surface 301 facing the first bus bar 20, and configured to restrict the position of the second bus bar 30 in the contact/separation direction and in the direction away from the first bus bar 20.

According to the connection unit 1 of the fifth aspect, the state in which the second bus bar 30 extends in the arrangement direction along the bus bar installation surface 16 can be maintained, and therefore, the occurrence of the defect in the electromagnetic relay 10 can be suppressed, the defect being the deformation of the second bus bar 30 in the contact/separation direction and in the direction away from the first bus bar 20.

In the connection unit 1 of the sixth aspect of the present disclosure, the housing 11 has the rectangular parallelepiped shape, the first fixed contact side terminal 12 is fixed to the one end side wall 112 orthogonal to the bus bar installation surface 16 of the housing 11 and on the one end side of the bus bar installation surface 16 in the arrangement direction, and the first bus bar 20 has the vertical member 23 extending along the one end side wall 112 toward the bus bar installation surface 16 and the cross member 24 extending from the vertical member 23 in the arrangement direction along the bus bar installation surface 16, the cross member 24 being restricted in position in the contact/separation direction and in the direction away from the bus bar installation surface 16 by the bus bar position restrictor 40.

The connection unit 1 further includes the auxiliary bus bar position restrictor 440 that restricts the position of the vertical member 23 of the first bus bar 20 in the arrangement direction and in the direction away from the one end side wall 112 of the housing 11.

According to the connection unit 1 of the sixth aspect, the state in which the first bus bar 20 extends in the arrangement direction along the bus bar installation surface 16 can be more reliably maintained, and therefore, the first bus bar 20 can be more reliably suppressed from being deformed in the contact/separation direction and in the direction away from the bus bar installation surface 16 by the electromagnetic repulsive force generated during energization between the movable touch piece 14 and the first bus bar 20. As a result, reduction in the electromagnetic repulsive force generated between the movable touch piece 14 and the first bus bar 20 due to the deformation of the first bus bar 20 can be suppressed, and the contact reliability of the connection unit 1 can be improved.

In the connection unit 1 of the seventh aspect of the present disclosure, the auxiliary bus bar position restrictor 440 is arranged only at the end of the one end side wall 112 closer to the bus bar installation surface 16.

According to the connection unit 1 of the seventh aspect, as compared to the case in which the auxiliary bus bar position restrictor 440 is provided over the entire contact/separation direction of the vertical member 23, the amount of material used to form the auxiliary bus bar position restrictor 440 can be suppressed.

In the connection unit 1 of the eighth aspect of the present disclosure, the bus bar position restrictor 40 includes:

the first member 41 extending from the bus bar installation surface 16 in the direction away from the bus bar installation surface 16 along the contact/separation direction; and the second member 42 extending from the end of the first member 41 farther from the bus bar installation surface 16, along the bus bar installation surface 16 toward the contact/separation direction and toward the direction orthogonal to the arrangement direction.

Further in the connection unit 1, the first bus bar 20 is arranged between the bus bar installation surface 16 and the second member 42.

According to the connection unit 1 of the eighth aspect, the state in which the first bus bar 20 extends substantially linearly in the arrangement direction along the bus bar installation surface 16 can be more reliably maintained with a simple configuration. Accordingly, the first bus bar 20 can be more reliably suppressed from being deformed in the contact/separation direction and in the direction away from the bus bar installation surface 16 by the electromagnetic repulsive force generated during energization due to the currents flowing in the opposite directions to each other through the movable touch piece 14 and the first bus bar 20.

In addition, by suitably combining any of the embodiments or modifications among the various embodiments or modifications, effects of each thereof can be exhibited. Further, combinations of the embodiments, combinations of the examples, or combinations of the embodiments and examples are possible, and combinations of features in different embodiments or examples are also possible.

While the present disclosure has been fully described in connection with preferred embodiments with reference to the accompanying drawings, various variations and modifications will be apparent to those skilled in the art. Unless such changes and modifications otherwise depart from the scope of the present disclosure as set forth in the appended claims, they should be construed as being included therein.

INDUSTRIAL APPLICABILITY

The connection unit of the present disclosure can be applied to, for example, an electric vehicle.

DESCRIPTION OF SYMBOLS

1 connection unit
2 battery
3 inverter
4 motor
5 generator
6 relay
7 resistor
10 electromagnetic relay
11 housing
111 first wall
112 second wall (an example of one end side wall)
113 third wall (an example of other end side wall)
114 fourth wall
12 first fixed contact side terminal
121 first fixed contact portion
13 second fixed contact side terminal
131 second fixed contact portion
14 movable touch piece
141 first movable contact portion
142 second movable contact portion
143 first plate surface
144 second plate surface
15 compartment
16 bus bar installation surface
20 first bus bar
21 connection point
22 screw
23 vertical member
24 cross member
30 second bus bar
31 screw
40 bus bar position restrictor (first bus bar position restrictor, first bus bar first position restrictor)
41 first member
42 second member
43 third member
44 gap
50 electromagnet unit
51 movable shaft
52 return spring
60 gap
70, 80 region
140 first bus bar second position restrictor
241, 242 protrusion
243 gap
340 second bus bar position restrictor
440 auxiliary bus bar position restrictor
CL center

The invention claimed is:

1. A connection unit comprising an electromagnetic relay comprising:

a housing having a compartment in an inside of the housing;

a first fixed contact side terminal fixed to the housing, and having a first fixed contact portion extending from an outside of the housing to the compartment and arranged in the compartment;

a second fixed contact side terminal fixed to the housing electrically independently of the first fixed contact side terminal, and having a second fixed contact portion extending from the outside of the housing to the compartment and arranged in the compartment; and a movable touch piece having a plate shape and arranged in the compartment, having a first movable contact portion arranged to face the first fixed contact portion and a second movable contact portion arranged to face the second fixed contact portion, and in which each of the first movable contact portion and the second movable contact portion is movable in a contact/separation direction in contact with or separated from the first fixed contact portion and the second fixed contact portion, respectively, the housing having a bus bar installation surface provided on an outer periphery of the housing and on a side of a second plate surface of the movable touch piece, the second plate surface being opposite in the contact/separation direction to a first plate surface on which the first movable contact portion and the second movable contact portion of the movable touch piece are provided, the first fixed contact side terminal having an end on an outer side of the housing, the end being positioned on a side of the bus bar installation surface in the contact/separation direction and on a one end side in an arrangement direction connecting the first movable contact portion and the second movable contact portion, the connection unit further comprising:

a first bus bar extending on the outside of the housing in the arrangement direction along the bus bar installation surface, overlapping with the movable touch piece in at least a portion of the first bus bar viewed from the contact/separation direction, and also connected to the first fixed contact side terminal at a one end in the arrangement direction, at a connection point on the one end side of the bus bar installation surface in the arrangement direction;

a second bus bar connected to the second fixed contact side terminal on the outside of the housing electrically independently of the first bus bar; and a bus bar position restrictor arranged on the bus bar installation surface with a gap in the arrangement direction from the connection point, and configured to restrict a position of the first bus bar in the contact/separation direction and in a direction away from the bus bar installation surface.

2. The connection unit according to claim 1, wherein the bus bar position restrictor is arranged on the bus bar installation surface in a region farther from the connection point in the arrangement direction than a center of the movable touch piece in the arrangement direction.

3. The connection unit according to claim 2, further comprising, while the bus bar position restrictor is referred to as a first bus bar first position restrictor, a first bus bar second position restrictor arranged in a different region on the bus bar installation surface to the first bus bar first position restrictor, and configured to restrict the position of the first bus bar in the contact/separation direction and in the direction away from the bus bar installation surface, wherein the first bus bar first position restrictor is arranged on the bus bar installation surface in a region farther from the connection point in the arrangement direction than the center of the movable touch piece in the arrangement direction, and the first bus bar second position restrictor is arranged on the bus bar installation surface in a region closer to the connection point in the arrangement direction than the center of the movable touch piece in the arrangement direction.

4. The connection unit according to claim 2, wherein the housing has a rectangular parallelepiped shape, wherein the second fixed contact side terminal is fixed to an other end side wall, the other end side wall being orthogonal to the bus bar installation surface of the housing and provided on an other end side of the bus bar installation surface in the arrangement direction, wherein the second bus bar extends in the arrangement direction along the first bus bar, wherein the first bus bar and the second bus bar each have a plate shape, and plate surfaces of the first bus bar and the second bus bar are arranged so as to face each other in the contact/separation direction, the connection unit further comprising a second bus bar position restrictor provided on a side of the plate surface of the second bus bar opposite to the plate surface facing the first bus bar and configured to restrict the position of the second bus bar in the contact/separation direction and in the direction away from the first bus bar.

5. The connection unit according to claim 2, wherein the housing has the rectangular parallelepiped shape, wherein the first fixed contact side terminal is fixed to a one end side wall, the one end side wall being orthogonal to the bus bar installation surface of the housing and provided on the one end side of the bus bar installation surface in the arrangement direction, wherein the first bus bar has a vertical member extending along the one end side wall toward the bus bar installation surface and a cross member extending from the vertical member in the arrangement direction along the bus bar installation surface, the cross member being restricted in position in the contact/separation direction and in the direction away from the bus bar installation surface by the bus bar position restrictor, the connection unit further comprising an auxiliary bus bar position restrictor configured to restrict a position of the vertical member of the first bus bar in the arrangement direction and in a direction away from the one end side wall of the housing.

6. The connection unit according to claim 1, further comprising, while the bus bar position restrictor is referred to as a first bus bar first position restrictor, a first bus bar second position restrictor arranged in a different region on the bus bar installation surface to the first bus bar first position restrictor, and configured to restrict the position of the first bus bar in the contact/separation direction and in the direction away from the bus bar installation surface, wherein the first bus bar first position restrictor is arranged on the bus bar installation surface in a region farther from the connection point in the arrangement direction than the center of the movable touch piece in the arrangement direction, and the first bus bar second position restrictor is arranged on the bus bar installation surface in a region closer to the connection point in the arrangement direction than the center of the movable touch piece in the arrangement direction.

7. The connection unit according to claim 6, wherein the housing has a rectangular parallelepiped shape, wherein the second fixed contact side terminal is fixed to an other end side wall, the other end side wall being orthogonal to the bus bar installation surface of the housing and provided on an other end side of the bus bar installation surface in the arrangement direction, wherein the second bus bar extends in the arrangement direction along the first bus bar, wherein the first bus bar and the second bus bar each have a plate shape, and plate surfaces of the first bus bar and the second bus bar are arranged so as to face each other in the contact/separation direction, the connection unit further comprising a second bus bar position restrictor provided on a side of the plate surface of the second bus bar opposite to the plate surface facing the first bus bar and configured to restrict the position of the second bus bar in the contact/separation direction and in the direction away from the first bus bar.

8. The connection unit according to claim 6, wherein the housing has the rectangular parallelepiped shape, wherein the first fixed contact side terminal is fixed to a one end side wall, the one end side wall being orthogonal to the bus bar installation surface of the housing and provided on the one end side of the bus bar installation surface in the arrangement direction, wherein the first bus bar has a vertical member extending along the one end side wall toward the bus bar installation surface and a cross member extending from the vertical member in the arrangement direction along the bus bar installation surface, the cross member being restricted in position in the contact/separation direction and in the direction away from the bus bar installation surface by the bus bar position restrictor, the connection unit further comprising an auxiliary bus bar position restrictor configured to restrict a position of the vertical member of the first bus bar in the arrangement direction and in a direction away from the one end side wall of the housing.

9. The connection unit according to claim 1, further comprising a pair of protrusions provided on the bus bar installation surface of the housing and also configured to sandwich the first bus bar together with the bus bar position restrictor, wherein the bus bar position restrictor is arranged on the bus bar installation surface at a center portion of the movable touch piece in the arrangement direction, and one of the pair of protrusions is arranged in a region farther from the connection point in the arrangement direction than the center of the movable touch piece in the arrangement direction, and an other of the pair of protrusions is arranged in a region closer to the connection point in the arrangement direction than the center of the movable touch piece in the arrangement direction.

10. The connection unit according to claim 9, wherein the housing has a rectangular parallelepiped shape, wherein the second fixed contact side terminal is fixed to an other end side wall, the other end side wall being orthogonal to the bus bar installation surface of the housing and provided on an other end side of the bus bar installation surface in the arrangement direction, wherein the second bus bar extends in the arrangement direction along the first bus bar, wherein the first bus bar and the second bus bar each have a plate shape, and plate surfaces of the first bus bar and the second bus bar are arranged so as to face each other in the contact/separation direction, the connection unit further comprising a second bus bar position restrictor provided on a side of the plate surface of the second bus bar opposite to the plate surface facing the first bus bar and configured to restrict the position of the second bus bar in the contact/separation direction and in the direction away from the first bus bar.

11. The connection unit according to claim 9, wherein the housing has the rectangular parallelepiped shape, wherein the first fixed contact side terminal is fixed to a one end side wall, the one end side wall being orthogonal to the bus bar installation surface of the housing and provided on the one end side of the bus bar installation surface in the arrangement direction, wherein the first bus bar has a vertical member extending along the one end side wall toward the bus bar installation surface and a cross member extending from the vertical member in the arrangement direction along the bus bar installation surface, the cross member being restricted in position in the contact/separation direction and in the direction away from the bus bar installation surface by the bus bar position restrictor, the connection unit further comprising an auxiliary bus bar position restrictor configured to restrict a position of the vertical member of the first bus bar in the arrangement direction and in a direction away from the one end side wall of the housing.

12. The connection unit according to claim 1, wherein the housing has a rectangular parallelepiped shape, wherein the second fixed contact side terminal is fixed to an other end side wall, the other end side wall being orthogonal to the bus bar installation surface of the housing and provided on an other end side of the bus bar installation surface in the arrangement direction, wherein the second bus bar extends in the arrangement direction along the first bus bar, wherein the first bus bar and the second bus bar each have a plate shape, and plate surfaces of the first bus bar and the second bus bar are arranged so as to face each other in the contact/separation direction, the connection unit further comprising a second bus bar position restrictor provided on a side of the plate surface of the second bus bar opposite to the plate surface facing the first bus bar and configured to restrict the position of the second bus bar in the contact/separation direction and in the direction away from the first bus bar.

13. The connection unit according to claim 12, wherein the housing has the rectangular parallelepiped shape, wherein the first fixed contact side terminal is fixed to a one end side wall, the one end side wall being orthogonal to the bus bar installation surface of the housing and provided on the one end side of the bus bar installation surface in the arrangement direction, wherein the first bus bar has a vertical member extending along the one end side wall toward the bus bar installation surface and a cross member extending from the vertical member in the arrangement direction along the bus bar installation surface, the cross member being restricted in position in the contact/separation direction and in the direction away from the bus bar installation surface by the bus bar position restrictor, the connection unit further comprising an auxiliary bus bar position restrictor configured to restrict a position of the vertical member of the first bus bar in the arrangement direction and in a direction away from the one end side wall of the housing.

14. The connection unit according to claim 1, wherein the housing has the rectangular parallelepiped shape, wherein the first fixed contact side terminal is fixed to a one end side wall, the one end side wall being orthogonal to the bus bar installation surface of the housing and provided on the one end side of the bus bar installation surface in the arrangement direction, wherein the first bus bar has a vertical member extending along the one end side wall toward the bus bar installation surface and a cross member extending from the vertical member in the arrangement direction along the bus bar installation surface, the cross member being restricted in position in the contact/separation direction and in the direction away from the bus bar installation surface by the bus bar position restrictor, the connection unit further comprising an auxiliary bus bar position restrictor configured to restrict a position of the vertical member of the first bus bar in the arrangement direction and in a direction away from the one end side wall of the housing.

15. The connection unit according to claim 14, wherein the auxiliary bus bar position restrictor is arranged only at an end of the one end side wall closer to the bus bar installation surface.

16. The connection unit according to claim 1, wherein the bus bar position restrictor includes a first member extending from the bus bar installation surface in the direction away from the bus bar installation surface along the contact/separation direction, and a second member extending from an end of the first member farther from the bus bar installation surface along the bus bar installation surface toward the contact/separation direction and toward the direction orthogonal to the arrangement direction, and wherein the first bus bar is arranged between the bus bar installation surface and the second member.

* * * * *